United States Patent [19]

Gauthier

[11] Patent Number: 4,995,474

[45] Date of Patent: Feb. 26, 1991

[54] SAFETY LADDER

[76] Inventor: Edward Gauthier, 38 Colorado St., Springfield, Mass. 01118

[21] Appl. No.: 467,400

[22] Filed: Jan. 22, 1990

[51] Int. Cl.[5] ..... E06C 7/44

[52] U.S. Cl. ..... 182/201; 248/188.4

[58] Field of Search ..... 182/201-205; 248/188.4

[56] References Cited

U.S. PATENT DOCUMENTS

| | | | |
|---|---|---|---|
| 332,684 | 12/1885 | Tuttle | 182/201 |
| 2,213,471 | 9/1940 | Minnick | 182/201 |
| 2,318,017 | 5/1943 | Schmidt | 182/201 |
| 2,584,015 | 1/1952 | Hawes | 182/201 |
| 3,791,487 | 2/1974 | Baumann | 182/201 |

*Primary Examiner*—Reinaldo P. Machado

*Attorney, Agent, or Firm*—Michael I. Kroll

[57] ABSTRACT

A safety ladder is disclosed. The safety ladder comprises at least two legs each of which containing a smooth longitudinal blind bore, a steel hollow pipe having an outer surface and being smoothly disposed in the longitudinal blind bore while providing additional strength to the at least two legs, a rod disposed concentrically in the steel hollow pipe and vacillating up and down therein without any hindrance so that its ease of operation is increased, a solid piece of steel drilled and tapped so as to contain a throughbore that will accommodate the steel hollow pipe, and a flat steel plate affixed to the solid piece of steel and containing a skewly drilled hole so that the skewly drilled hole lines up with the outer surface of the steel hollow pipe.

8 Claims, 2 Drawing Sheets

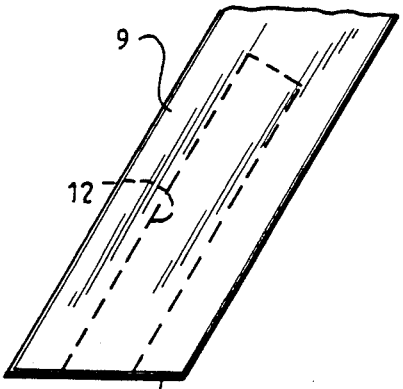
Fig. 1
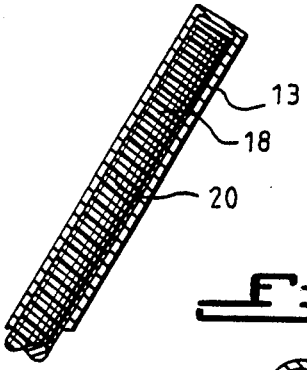
Fig. 2
Fig. 4
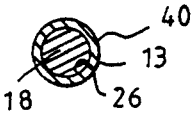
Fig. 5
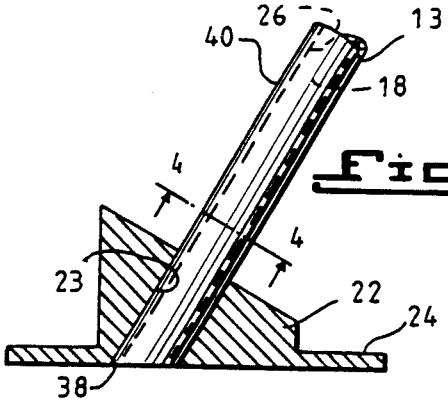
Fig. 3
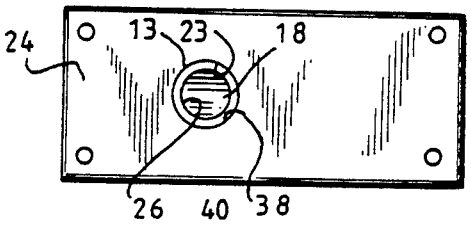
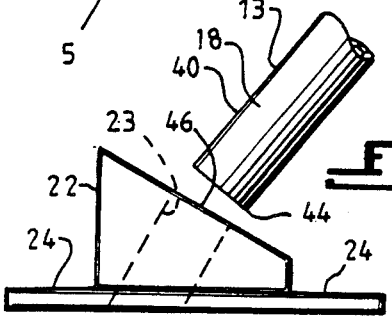
Fig. 6
Fig. 7
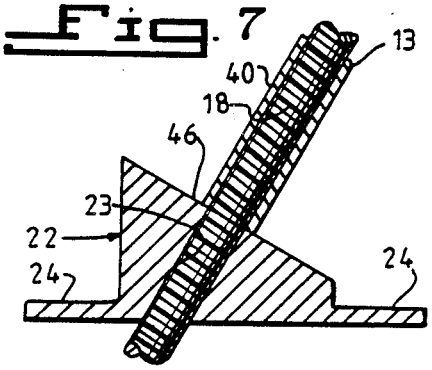
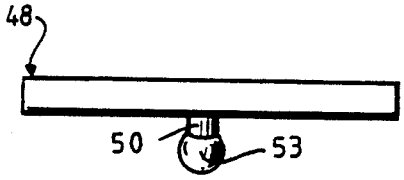
Fig. 8
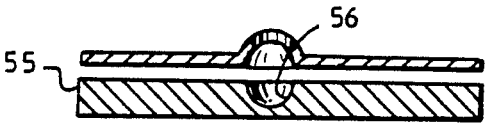
Fig. 9

SAFETY LADDER

BACKGROUND OF THE INVENTION

1. Field of the Invention

The present invention relates to a ladder.

More particularly, the present invention relates to a safety ladder.

2. Description of the Prior Art

Typical home owners have a constant need for ladders of different sizes for doing home repairs. There is always something that has to be fixed or cleaned, etc.

Everyone at one time or another has used a rock, a block of wood, or one thing or another to stand on when a high reach is required. There has to be a safer way than this to reach high places.

Numerous innovations for ladders have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a safety ladder that avoids the disadvantage of the prior art.

More particularly, it is an object of the present invention to provide the adjustable ladder of the present invention which can be used by homeowner's, carpenters, painters, and electricians, to name a few. With less on the job accidents in which a ladder may have been involved, business, and industry and most importantly, insurance companies would increase assets, since there would be a decrease in workman's compensation claims, and with less employees getting hurt and not to mention the pain the employees would be avoiding to themselves. Less injury equals less pain. No injury equals no pain.

With no admission or disclaimer, there will always be those who "throw caution to the wind". However, with the proper handling of the safety ladder of the present invention, injuries involving ladders would be reduced in the first year of use by approximately ⅓ and by approximately ½ by the second year.

The safety ladder of the present invention is cost effective since it should not cause a raise in the price of a ladder incorporating the present invention.

In keeping with these objects, and with others which will become apparent hereinafter, one feature of the present invention resides, briefly stated, in an adjustable ladder, comprising at least two legs each of which containing a smooth longitudinal blind bore, a steel hollow pipe having an outer surface and being smoothly disposed in the longitudinal blind bore while providing additional strength to at least two legs, a rod disposed concentrically in the steel hollow pipe and vacillating up and down therein without any hindrance so that its ease of operation is increased, a solid piece of steel drilled and tapped so as to contain a throughbore that will accommodate the steel hollow pipe, and a flat steel plate affixed to the solid piece of steel and containing a skewly drilled hole.

When the safety ladder is designed in accordance with the present invention, the skewly drilled hole lines up with the outer surface of the steel hollow pipe.

In accordance with another feature of the present invention, the longitudinal blind bore is disposed on center of each of the at least two legs.

Another feature of the present invention is that the rod is made of steel for safety and strength.

Yet another feature of the present invention is that the rod contains male external threads.

Still another feature of the present invention is that the steel hollow pipe is welded to the flat steel plate.

Yet still another feature of the present invention is that the steel hollow pipe enters the solid piece of steel at a skew angle.

Still yet another feature of the present invention is that the turning collar, the pivot stem, and the ball can be made as one homogeneous part.

Another feature of the present invention is that it further comprises a lower portion of a pad which is solid and contains a substantially spherical recess which receives the ball of the pivot stem.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is a side view of a leg of the safety ladder of the present invention containing a longitudinal blind bore;

FIG. 2 is a cross-sectional view showing the hollow pipe and the steel rod disposed concentrically within the hollow pipe;

FIG. 3 is a partial side cross-sectional view of the hollow pipe and the steel rod, both being disposed in and skew to the steel base;

FIG. 4 is a top cross-sectional view of the pipe and the rod of the safety ladder of the present invention, taken along line 4—4 in FIG. 3;

FIG. 5 is a plan view of the bottom of the flange plate of the present invention, taken in the direction of the arrow 5 in FIG. 3;

FIG. 6 is a partial side cross-sectional view of the pipe about to enter the hole in the steel base;

FIG. 7 is a partial side cross-sectional view of the pipe inside the hole in the steel base;

FIG. 8 is a side cross-sectional view of the upper portion of the swivel pad;

FIG. 9 is a side cross-sectional view of the lower portion of the swivel pad;

LIST OF REFERENCE NUMERALS UTILIZED IN THE DRAWING

Figure 10:
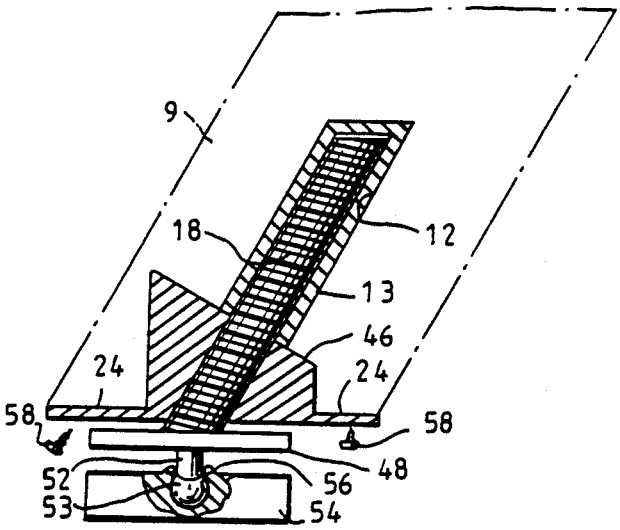
FIG. 10 is a side cross-sectional view of the ladder leg of the present invention and showing the relationship of the related parts.
Figure 11:
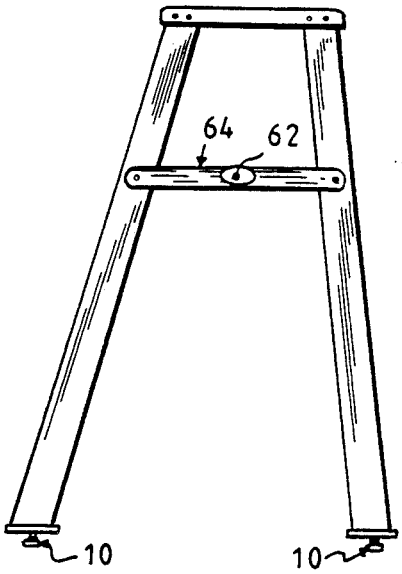
FIG. 11 is a side view of a ladder utilizing the leg and the ladder bracket of the present invention.
Figure 12:
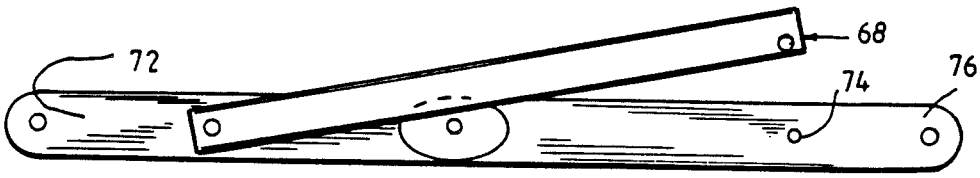
FIG. 12 is a side view of the ladder bracket of the present invention.
Figure 13:
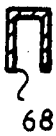
FIG. 13 is a cross-sectional view of the channel of the present invention.
Figure 14:
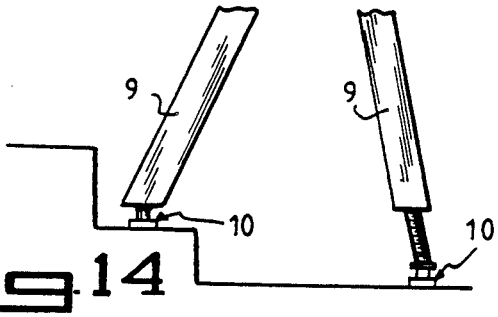
FIG. 14 is a side view of the ladder legs of the present invention that are adjustable for safe use on any terrain.
Figure 15:
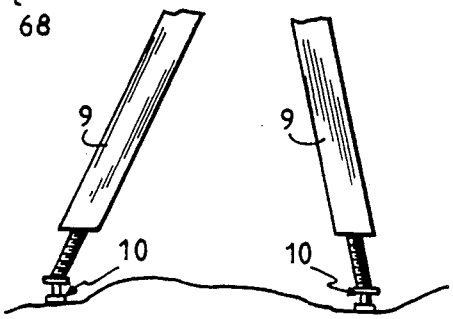
FIG. 15 is a side view of the ladder legs of the present invention that are adjustable for safe use on any terrain.
Figure 16:
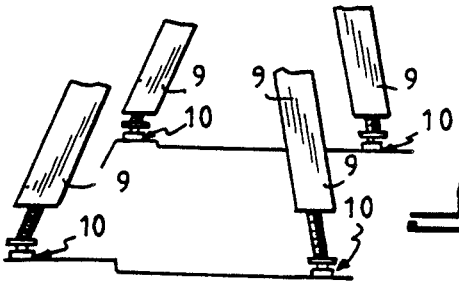
FIG. 16 is a side view of the ladder legs of the present invention that are adjustable for safe use on any terrain.

9—conventional ladder leg
10—safety ladder
12—blind bore
14—center
16—steel hollow pipe
18—rod
20—threads
22—solid piece of steel
23—throughbore
24—flat steel plate
25—flanges
26—throughbore
38—hole
40—outer surface
42—skew angle
44—point
48—top portion
50—pivot stem
53—ball
54—pad
55—lower portion
56—substantially spherical recess
58—screws
60—joint
62—center
64—bracket
66—straight bar
68—channel
72—one side
74—hole
76—other side
78—bolt
80—"C"-ring

DETAILED DESCRIPTION OF THE PREFERRED EMBODIMENT

Referring now to the FIGURES wherein like numerals indicate like parts.

IT IS TO BE UNDERSTOOD THAT THE LADDER LEG DESCRIBED IS REPRESENTATIVE OF ALL FOUR OF THE LADDER LEGS USED IN THE PRESENT INVENTION.

The conventional ladder leg 9 used in the safety ladder 10 of the present invention is drilled as shown, and forms a blind bore 12 in the middle 14 of the conventional ladder leg 9. The blind bore 14 is reamed to snugly accommodate a steel hollow pipe 13.

No strength is lost in the leg 9 by drilling the blind bore 12. If anything, the strength has increased since the steel hollow pipe 13 provides added strength.

Additionally, the smooth blind bore 12 allows the hollow pipe 13 to vacillate up and down therein without any hindrance, so as to add to its ease of operation.

The rod 18 contains external threads 20 and is made of steel for safety and strength. The rod 18 is disposed in the steel hollow pipe 13.

A solid piece of steel 22 is drilled and tapped to contain a throughbore 23 that will accommodate the steel rod 13.

A longitudinal bore is drilled in the center 14 of the rod 18 and forms a throughbore 26. The steel hollow pipe 13 is welded to the flat steel plate 24.

A hole 38 is skewly drilled, not tapped, in the flat steel plate 24 so that the hole 38 lines up with the outer surface 40 of the steel hollow pipe 13.

When the drilling and required tapping is completed, the flat steel plate 24 is screwed onto the bottom of the leg 9 and functions to hold the full assembly in the conventional ladder leg 9.

The steel hollow pipe 13 enters the solid piece of steel 22 at a skew angle.

In order to identify this skew angle 42 at which the steel hollow pipe 13 is to be cut, the steel hollow pipe 13 is slid into the solid piece of steel 22 until the point 44 just touches the flanges 25 of the solid piece of steel 22. At this point, merely mark the steel hollow pipe 13 by using the flange 25 as a guide. Since the steel hollow pipe 13 is cut at an angle, its cross-section will be oval (elliptical), not round.

After the pipe 13 is cut, and the flange 24 is securely in place, the rod 18 will move up and down in a smooth manner.

The turning collar 48, the pivot stem 50, and the ball 52 can be one homogeneous piece. By rotating the turning collar 48, either left or right, the rod 18 will move up or down, respectively.

The top portion 48 of the pad 54 is solid and allows movement of the stem 50. The lower portion 55 of the pad 54 is also solid and has a substantially spherical recess 56 which receives the ball portion 53 of the stem 50.

The substantially spherical recess 56 is in the lower portion 55 and the ball 53 is on the top portion 48 so that the formed joint 60 will swivel much freer and easier.

The steel hollow pipe 13 snugly secures itself inside of the conventional ladder leg 9. The flange 24 disposed on the bottom of the conventional ladder leg 9, is screwed to the bottom of the conventional ladder leg 9 by screws 58. This position will also help hold the steel hollow pipe 13 in the conventional ladder leg 9. Additionally, by screwing flange 24 on to the bottom of the conventional ladder leg 9, will insure free movement of the present invention relative to the conventional ladder leg 9.

The center 62 of the bracket 64 that opens and holds the ladder apart usually snaps loose if the ladder is not substantially plumb when positioned.

The bracket 64 of the present invention includes a straight bar 66, bent square with an open bottom. The straight bar 66 assumes the configuration of an upside down channel 68. The channel 68 is riveted to one side 72. A hole 74 is drilled on the other side 76 through both bracket 64 and channel 68. A bolt 78 placed through both the channel 68 and the bracket 64. A "C" ring 80 is used to hold the bolt 78 in added safety.

The safety ladder 10 of the present invention allows all four legs 9 to adjust to different lengths independently of each other. This gives the safety ladder 10 a wider variety of applications.

It will be understood that each of the elements described above, or two or more together, may also find a useful application in other types of constructions differing from the type described above.

While the invention has been illustrated and described as embodied in a safety ladder, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims; I claim

1. An adjustable ladder, comprising:

(a) at least two legs each of which containing a smooth longitudinal blind bore;

(b) a steel hollow pipe having an outer surface and being smoothly disposed in said longitudinal blind bore while providing additional strength to said at least two legs;

(c) a rod disposed concentrically in said steel hollow pipe and vacillating up and down therein without any hindrance so that its ease of operation is increased;

(d) a solid piece of steel drilled and tapped so as to contain a throughbore that will accommodate said steel hollow pipe; and (e) a flat steel plate affixed to said solid piece of steel and containing a skewly drilled hole so that said skewly drilled hole lines up with said outer surface of said steel hollow pipe.

2. A ladder as defined in claim 1, wherein said longitudinal blind bore is disposed on center of said each of said at least two legs.

3. A ladder as defined in claim 2, wherein said rod is made of steel for safety and strength.

4. A ladder as defined in claim 3, wherein said rod contains male external threads.

5. A ladder as defined in claim 4, wherein said steel hollow pipe is welded to said flat steel plate.

6. A ladder as defined in claim 5, wherein said steel hollow pipe enters said solid piece of steel at a skew angle.

7. A ladder as defined in claim 6; further comprising a turning collar, a pivot stem, and a ball, said turning collar, said pivot stem, and said ball are usually made as one homogeneous part.

8. A ladder as defined in claim 7; further comprising a lower portion of a pad, said lower portion of said pad is solid and contains a substantially spherical recess which receives said ball of said pivot stem.

* * * * *